US005920998A

United States Patent [19]

Slilaty

[11] Patent Number: 5,920,998

[45] Date of Patent: Jul. 13, 1999

[54] FITTING DEVICE FOR ARTICLES OF CLOTHING

[76] Inventor: Halim Slilaty, 101 Main St., Binghamton, N.Y. 13905

[21] Appl. No.: 08/890,838

[22] Filed: Jul. 10, 1997

[51] Int. Cl.[6] ..... A41H 1/02; G01B 3/10

[52] U.S. Cl. ..... 33/512; 33/2 R; 33/759; 33/760; 33/770; 2/129; 2/1

[58] Field of Search ..... 33/512, 2 R, 11, 33/12, 14, 16, 17 R, 755, 758, 759, 760, 770, 511, 555.1, 555.4; 2/116, 129, 1

[56] References Cited

U.S. PATENT DOCUMENTS

| | | | |
|---|---|---|---|
| 947,542 | 1/1910 | De Feo | 33/2 R |
| 2,740,966 | 4/1956 | Bihaly | 2/129 |
| 3,849,886 | 11/1974 | Weyrick et al. | 33/2 R |

*Primary Examiner*—Christopher W. Fulton
*Attorney, Agent, or Firm*—Salzman & Levy

[57] ABSTRACT

A new tape measure system and a new combination collar-and-tape measuring tool, actually worn by the user, is described. The collar-and-tape measuring tool allows for adjustments to the fitting that befits individual preferences and natural fit selection. The collar-and-tape measuring tool has a front portion of a fake collar (i.e., a half portion of a regular collar). To this front portion is attached a tape measure. Ground zero of the tape begins at the edge portion of the fake half collar, where the measurement point of the loose tape end is attached. The tape has graduated measurement markings disposed on the outside, as is standard with ordinary tape measures. On the inside of the tape is disposed a lining of Velcro® material, or another type of attaching material forming an adhesive surface. The loose end of the tape is drawn around the neck, meeting the ground zero edge of the half collar. The collar-and-tape tool is then secured by a mating adhesive surface (e.g., Velcro), so that it becomes worn upon the neck of the person being fitted. The worn collar-and-tape device of this invention will bear the natural drape associated with a worn collar; therefore, a more exacting fit measurement is achieved.

15 Claims, 2 Drawing Sheets

FITTING DEVICE FOR ARTICLES OF CLOTHING

FIELD OF THE INVENTION

The present invention relates to devices used for measuring and fitting individuals for articles of clothing and apparel, and more particularly to a device for obtaining the precise neck size for shirts.

BACKGROUND OF THE INVENTION

In the clothing making and fitting arts, the standard tape measure is the measuring tool of choice, for which most clothing measurements can be readily attained. The one exception to this rule seems to be measuring the collar size. Taking the measurement of the neck of an individual (i.e., stretching a tape measure around the circumference of the neck) does not always guarantee that the proper collar fit will be achieved. The problem appears to be related to the position of the collar as it drapes about the neck. Most collars fit in an elliptical orb about the neck of the individual. In other words, the collar drapes downwardly around the neck, to some degree. Therefore, when a fitter or clothes-maker measures the size of the neck in the standard circumferential manner, it is often a surprise to find that the collar does not fit exactly when the shirt is worn for the first time.

This invention seeks to provide a new type of tape measure designed specifically for neck measurements. The tape measure of this invention is made integrally with the front part of a fake shirt collar (i.e., a half collar portion). When the tape is drawn about the neck, the front portion of the fake collar (half portion) takes the natural drape of a full sized collar. Thereafter, the measurement of the neck includes the natural draping tolerances built into the shirt collar, and the shirt measurement becomes more exact.

The invention also incorporates another little secret that makes it successful. The tape measuring device of this invention does not place the beginning edge of the tape measuring tool against the length of the stretched tape, as is standard practice. Rather, the new shirt tape device starts the ground zero measurement from the edge portion of the fake half collar, and follows it around until it meets the same edge of the fake half collar portion. At that junction, the exact fit is easily assessed. This little secret is most useful, because certain individuals prefer a little more drape or looseness in the collar than do others. In other words, this invention allows for the natural fit selection and preferences of the user. The measurement is more accurate as befits the individual, since the tape is actually worn about the neck, rather than being pinched to the neck by the fitter.

In order to allow the user to wear the tape in its most comfortable position, the tape is made easily adjustable through the use of a Velcro® lining. The Velcro lining attaches the measurement portion of the tape to the far edge of the fake collar that contains a mating Velcro strip. In this manner, the collar-tape device is worn about the neck. If the person being fitted prefers a tighter fit, then the tape can be cinched a little tighter. In this manner, the Velcro attachment allows for quick adjustment.

SUMMARY OF THE INVENTION

It is an object of this invention to provide an improved tape measuring device for determining the collar size of a shirt.

It is another object of the invention to provide a new measuring tool for clothing that can be worn about the person being fitted, to achieve a more natural and preferential fit.

In accordance with the present invention, there is provided a measuring device for determining the proper neck size for a shirt collar. The invention reflects the discovery that neck size cannot be accurately determined using a standard tape measure, pinching the tape together at the point of fit. A new tape measure system and a new combination collar-and-tape measuring tool, actually worn by the user, have been developed. The collar-and-tape measuring tool allows for adjustments to the fitting that befits individual preferences and natural fit selection. The collar-and-tape measuring tool comprises a front portion of a fake collar (i.e., a half portion of a regular collar). To this front portion is attached a tape measure. Ground zero of the tape begins at the edge portion of the fake half collar, where the measurement point of the loose tape end is attached.

The tape has graduated measurement markings disposed on the outside, as is standard with ordinary tape measures. On the inside of the tape is disposed a lining of Velcro material, or another type of attaching material forming an adhesive surface. The loose end of the tape is drawn around the neck to where it meets the ground zero edge of the half collar. The collar-and-tape tool is then secured by means of a mating adhesive surface (e.g., Velcro), so that it becomes worn upon the neck of the person being fitted. The worn collar-and-tape device of this invention will bear the natural drape associated with a worn collar; therefore, a more exacting fit measurement is achieved. Naturally, the inventive device can be adjusted easily to provide a looser fit about the neck, or a tighter fit about the neck, in accordance with the preference of the wearer.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same designation and numbering throughout the figures.

DESCRIPTION OF THE PREFERRED EMBODIMENT

Generally speaking, the invention features a new method and apparatus for measuring the neck size of a person being fitted for a shirt. The apparatus comprises a tape measure that forms part of a fake collar (i.e., a half collar portion), attached to a tape measure to form a "collar-and-tape" device. The new method of measuring neck size of the individual being fitted for a shirt comprises the steps of securing the collar-and-tape device around the individual, so that the individual wears this measuring device. Adjustments of fit are made upon the individual, loosening or tightening the apparatus until a comfortable fit is achieved. This then becomes the correct measurement of that person's neck size for a shirt.

Figure 1:
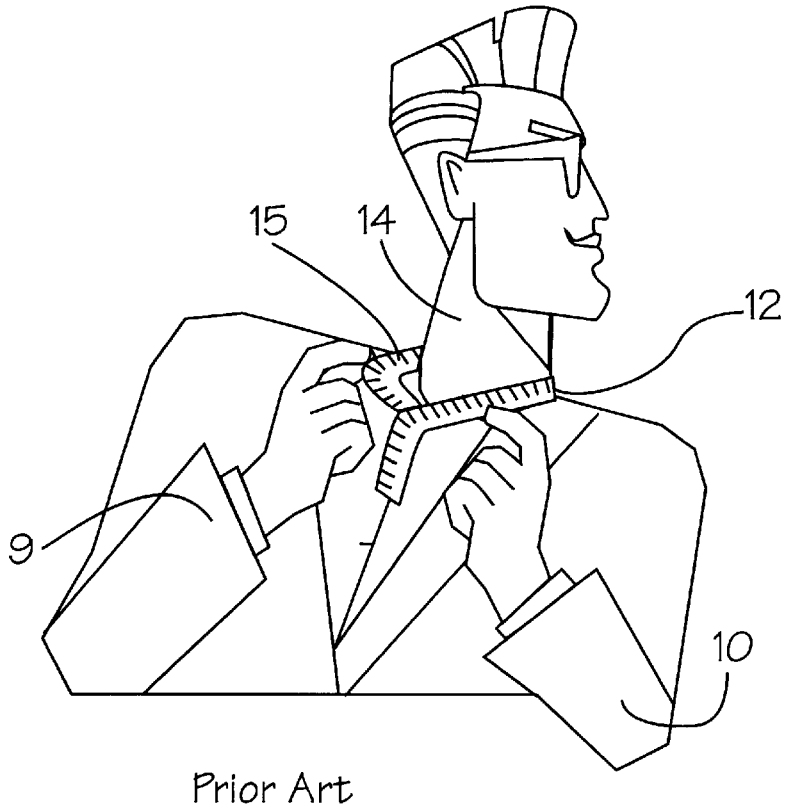
FIG. 1 illustrates a perspective, in situ view of a standard neck tape measurement, as is well known in the prior art.

Referring to FIG. 1, a prior art, in situ perspective view is shown of a fitting person whose hands 9 and 10 are pulling a measuring tape 12 about the neck 14 of an individual, in order to obtain the neck size. The tape 12 has the standard tape graduations disposed thereon. The tape 12 is drawn around the neck 14 of the person, and the ground zero edge of the tape 12 is pinched into contact with the loose end 15 of the tape, in order to obtain a reading. This is a standard procedure of making measurements about the body of the individual, including neck 14.

The problem associated with using this method of measurement for obtaining a neck size for a collar of a shirt is that the average collar, not shown, fits about neck 14 in an elliptical orb pattern. In other words, the collar tends to drape about the neck. Yet, the taking of the neck measurement in the usual, prior art way results in a substantially round or circumferential measurement. Therefore, the standard measurement does not take into account the natural drape of a shirt collar.

To make matters even more complicated, each individual has preferences with respect to the looseness or tightness of his or her collar. Therefore, how does a fitter tell whether the attained measurement reflects the collar size of the individual being measured? The answer is that he or she does not really have a clue, although an educated guess can be made when observing the individual trying on a shirt in the establishment. Even so, any measurement made prior, or subsequent to, such observation can be only an estimated value.

This invention is a measuring device that can be worn like a regular collar, and therefore will comprise in its measurement both the natural drape of the collar about the neck of the wearer, and the preference of the wearer respecting that drape. In other words, the measurement to be made with the invention will follow the elliptical orb of the collar about the neck, and will be a function of whether that individual prefers that the elliptical orb be relatively tight or loose.

Figure 2:
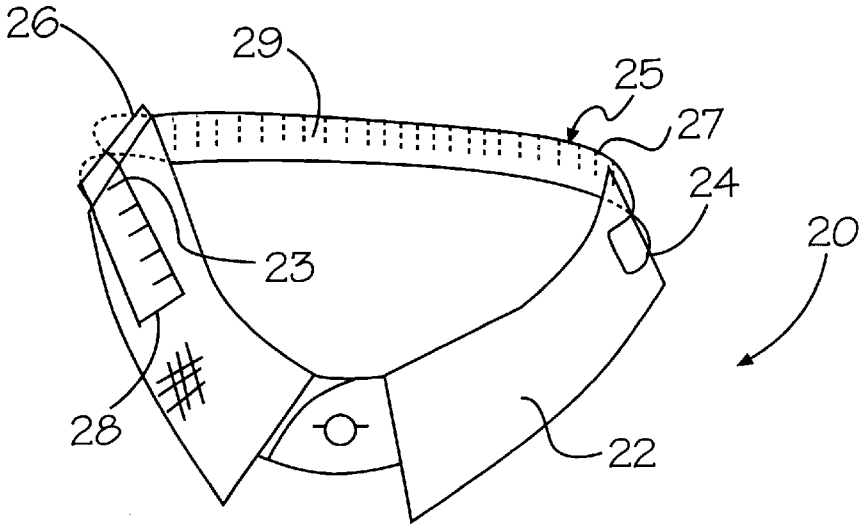
FIG. 2 shows a perspective view of the collar-and-tape tool of this invention.
Figure 3:
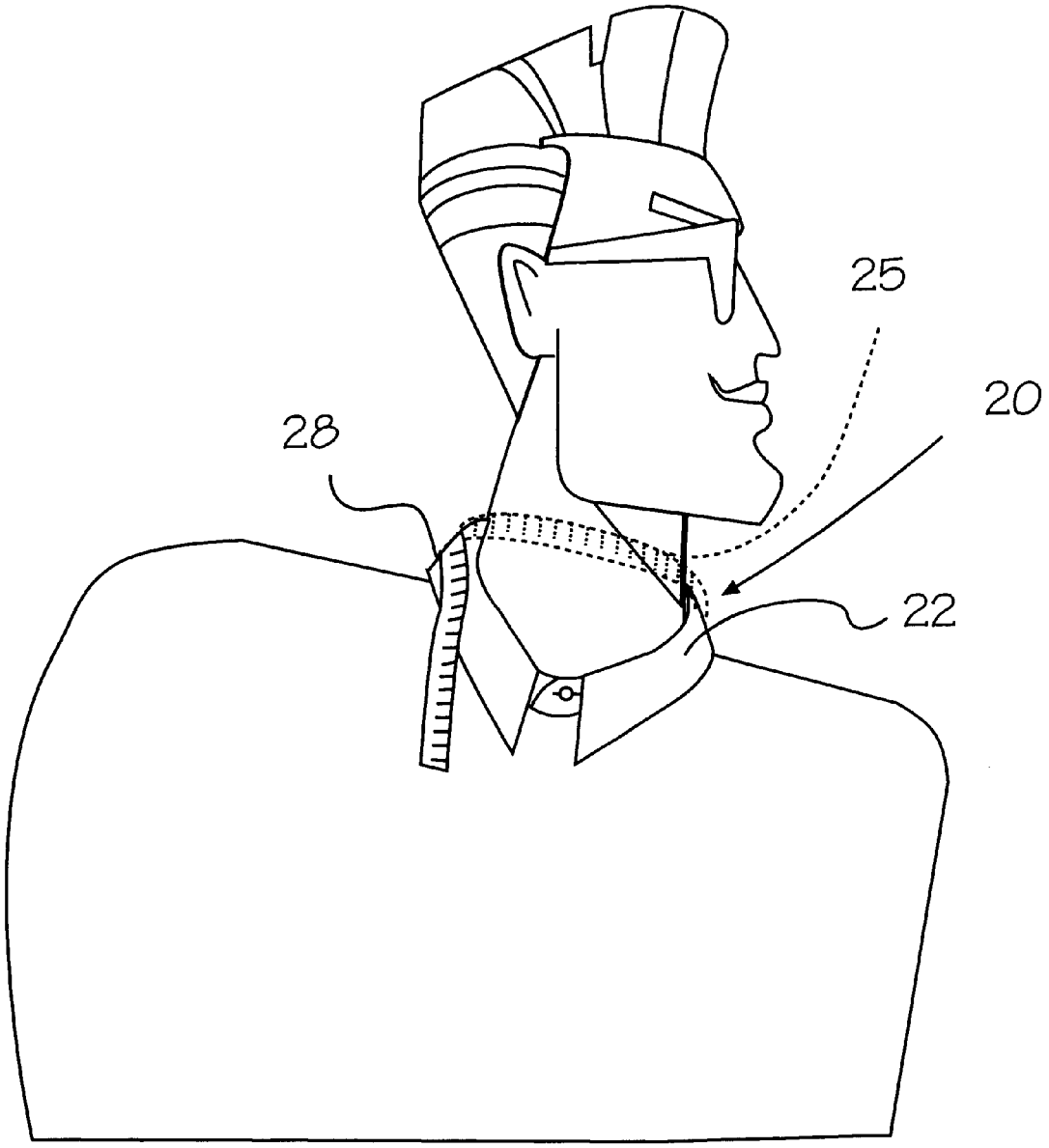
FIG. 3 depicts an in situ, perspective view of the collar-and-tape device illustrated in FIG. 2, being worn upon a person fitted for a shirt.

Referring to FIG. 2, the "collar-and-tape" device 20 of this invention is illustrated. The device 20 comprises a fake half collar 22 of a shirt, not completely shown. To the right edge 24 of the fake half collar 22 is sewn a tape measure 25. The tape measure 25 has measurement markings on its outer circumferential surface 27. However, the zero point of the tape measure 25 does not begin at the right edge 24 of the fake half collar 22, but rather begins from the left edge 26. Therefore, the tape measure 25 starts with approximately 13 and ¾ inches at point 25. The loose end 28 of the tape 25 is designed to be drawn about the neck 14 of the individual until a portion of the loose end 28 is contacted and secured to the left edge 26 of fake half collar 22. When so secured, the collar-and-tape device 20 is worn about neck 14, as shown in FIG. 3.

As aforementioned, the tape 25 has measurement markings on its outer circumferential surface 27. On its inner circumferential surface 29 is disposed an adhesive surface such as a Velcro stripping. This makes possible the quick attachment of the loose end 28 of the tape 25 to the edge 26 of the fake half collar 22, which comprises a patch 23 of the mating Velcro material sewn thereto. The patch 23 allows the loose end 28 of tape 25 to be easily reattached or refitted to edge 26, when the collar-and-tape 20 is affixed to the neck of the individual. Thus, it is possible to adjust, readjust, loosen, or tighten the fake half collar 22 in accordance with the individual preferences of the wearer.

The Velcro material allows for quick attachment and detachment of the tape 25 to the fake half collar 22. However, other adhesive materials can be used, if so desired. The fake half collar 22 can be fabricated in any of various shirt collar styles, as befits the preferences of the individual. In other words, the fake half collar 22 will drape differently depending upon the collar style. It will also be observed that the height of the collar also affects the drape about the neck. Typical shirt collar styles are: standard, notched, banded, tab, nehru, button down, pinned, asymmetrical, Peter Pan, shawl, flat, rolled, etc. By designing the collar-and-tape to the various collar styles and heights, a more accurate measurement will be obtained. Each of these styles and heights may have a slightly different elliptical orb about the neck.

It should also be noted that neck sizes often vary with respect to their longitudinal dimension, or height. Certain necks are wider at their base than at their apex, for example. All of these factors make the standard circumferential measurements of neck size inaccurate in determining the way the collar should fit the individual.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A neck measuring device comprising a collar-and-tape combination, said collar-and-tape combination including a partial portion of a shirt collar to which a measuring tape is attached, said measuring tape having a fixed end and a free end, said fixed end being attached to said partial portion of said shirt collar at a first distal end, and said loose end having means for attaching said measuring tape to a second distal end of said partial portion of said shirt collar.

2. The neck measuring device in accordance with claim 1, wherein said measuring tape has measuring graduations disposed on an outer periphery thereof.

3. The neck measuring device in accordance with claim 1, wherein said measuring tape has adhesive means disposed on an inner periphery thereof.

4. The neck measuring device in accordance with claim 2, wherein said measuring graduations of said measuring tape have a zero graduation value originating at a distal edge portion of said shirt collar.

5. The neck measuring device in accordance with claim 3, wherein said adhesive means of said measuring tape comprises Velcro® material.

6. The neck measuring device in accordance with claim 4, wherein said shirt collar includes an adhesive patch on the distal edge related to said zero graduation.

7. The neck measuring device in accordance with claim 5, wherein said adhesive means of said measuring tape comprises Velcro® material, and further wherein said shirt collar comprises a mating Velcro® adhesive patch on the distal edge related to said zero graduation.

8. A method of measuring neck size of an individual, comprising the steps of:

a) applying a collar-and-tape combination about a neck of an individual;

b) wearing said collar-and-tape combination in a comfortable position; and c) taking a measurement reading from a tape portion of said collar-and-tape combination.

9. A neck measuring device comprising a collar-and-tape combination, said collar-and-tape combination including a partial portion of a shirt collar to which a measuring tape is attached, said measuring tape having a fixed end and 5 a free end, said fixed end being attached to said partial portion of said shirt collar at a first distal end, and said free end having means for attaching said measuring tape to a second distal end of said partial portion of said shirt collar, said tape having measuring graduations disposed thereon, and means for affixing said measuring tape to said partial portion of said shirt collar.

10. The neck measuring device in accordance with claim 9, wherein said measuring graduations are disposed on an outer periphery of said tape.

11. The neck measuring device in accordance with claim 9, wherein said means for affixing said measuring tape to said partial portion of said shirt collar includes adhesive means disposed on an inner periphery thereof.

12. The neck measuring device in accordance with claim 10, wherein said measuring graduations of said measuring tape have a zero graduation value originating at a distal edge portion of said shirt collar.

13. The neck measuring device in accordance with claim 11, wherein said adhesive means of said measuring tape comprises Velcro® material.

14. The neck measuring device in accordance with claim 12, wherein said shirt collar includes an adhesive patch on the distal edge related to said zero graduation.

15. The neck measuring device in accordance with claim 11, wherein said adhesive means of said measuring tape comprises Velcro® material, and further wherein said shirt collar comprises a mating Velcro® adhesive patch on a distal end related to a zero graduation value of said measuring tape.

* * * * *